US007939739B1

(12) United States Patent
Sadegh et al.

(10) Patent No.: US 7,939,739 B1
(45) Date of Patent: May 10, 2011

(54) PAGE TURNER WITH MOVING PAGE RETAINING ARMS AND METHOD OF OPERATION

(75) Inventors: Ali M. Sadegh, Franklin Lakes, NJ (US); George Wolberg, Woodmere, NY (US)

(73) Assignee: PageFlip, Inc., Woodmere, NY (US)

( * ) Notice: Subject to any disclaimer, the term of this patent is extended or adjusted under 35 U.S.C. 154(b) by 0 days.

(21) Appl. No.: 12/685,107

(22) Filed: Jan. 11, 2010

(51) Int. Cl.
*G10G 7/00* (2006.01)

(52) U.S. Cl. ..... 84/486

(58) Field of Classification Search ..... 84/486–489, 84/491–516
See application file for complete search history.

(56) References Cited

U.S. PATENT DOCUMENTS

| | | | | |
|---|---|---|---|---|
| 3,860,494 | A | | 1/1975 | Hickman |
| 4,040,195 | A | | 8/1977 | Claypool et al. |
| 4,160,334 | A | | 7/1979 | Willis |
| 4,432,154 | A | | 2/1984 | D'Arcy |
| 4,644,675 | A | | 2/1987 | Berger et al. |
| 4,685,375 | A | | 8/1987 | Ross et al. |
| 4,719,712 | A | | 1/1988 | Moreau et al. |
| 4,773,297 | A | | 9/1988 | Anderson |
| 5,203,248 | A | | 4/1993 | Carr et al. |
| 5,233,900 | A | | 8/1993 | Fitzgerald |
| 5,373,772 | A | | 12/1994 | Shemoul |
| 5,493,943 | A | * | 2/1996 | Horikawa ..... 84/519 |
| 5,575,097 | A | | 11/1996 | Chou et al. |
| 5,962,801 | A | | 10/1999 | Bowman et al. |
| 6,049,033 | A | | 4/2000 | Dallas |
| 6,107,558 | A | | 8/2000 | Cowan |
| 6,215,058 | B1 | | 4/2001 | Molchak et al. |
| 6,375,803 | B1 | | 4/2002 | Razzaghi et al. |
| 6,841,726 | B2 | | 1/2005 | Steffens et al. |
| 6,935,058 | B2 | | 8/2005 | Sadegh et al. |
| 7,019,203 | B2 | | 3/2006 | Wolberg et al. |
| 7,238,872 | B1 | | 7/2007 | Edwards et al. |
| 7,307,207 | B1 | | 12/2007 | Davis |
| 7,440,148 | B2 | | 10/2008 | Stemmle et al. |
| 2005/0230592 | A1 | | 10/2005 | Tillinghast et al. |

* cited by examiner

*Primary Examiner* — Kimberly R Lockett
(74) *Attorney, Agent, or Firm* — Denton L. Anderson; Sheldon Mak & Anderson PC

(57) ABSTRACT

A page turner apparatus includes a book holder assembly, one or more page turning assemblies and a driver. Each page turning assembly includes a rotator portion and a page retention portion and is laterally movable and rotatable. The page retention portion includes a page retaining arm which is rotated to the right of an axis of rotation when the page turning assembly is moved to the right and rotated to the left of the axis of rotation when the page turning assembly is moved to the left. The driver is adapted to laterally move the at least one page turning assembly and, at the same time, rotate each page retaining arm.

15 Claims, 9 Drawing Sheets

FIG. 4
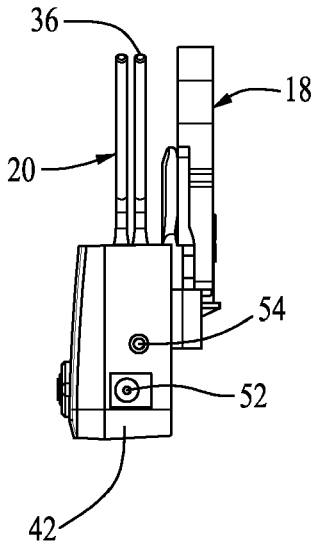
FIG. 5
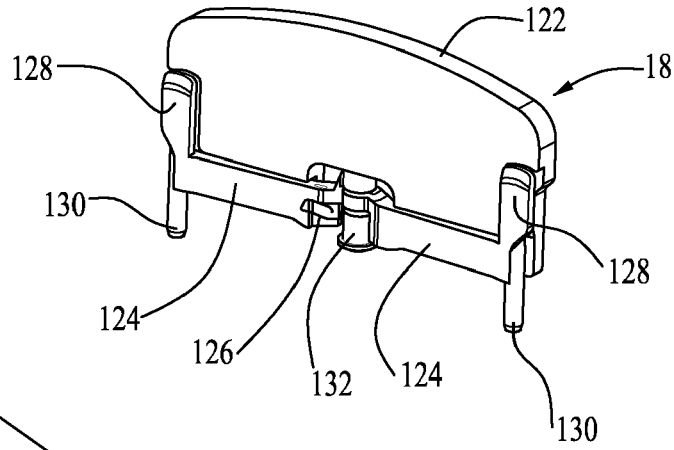
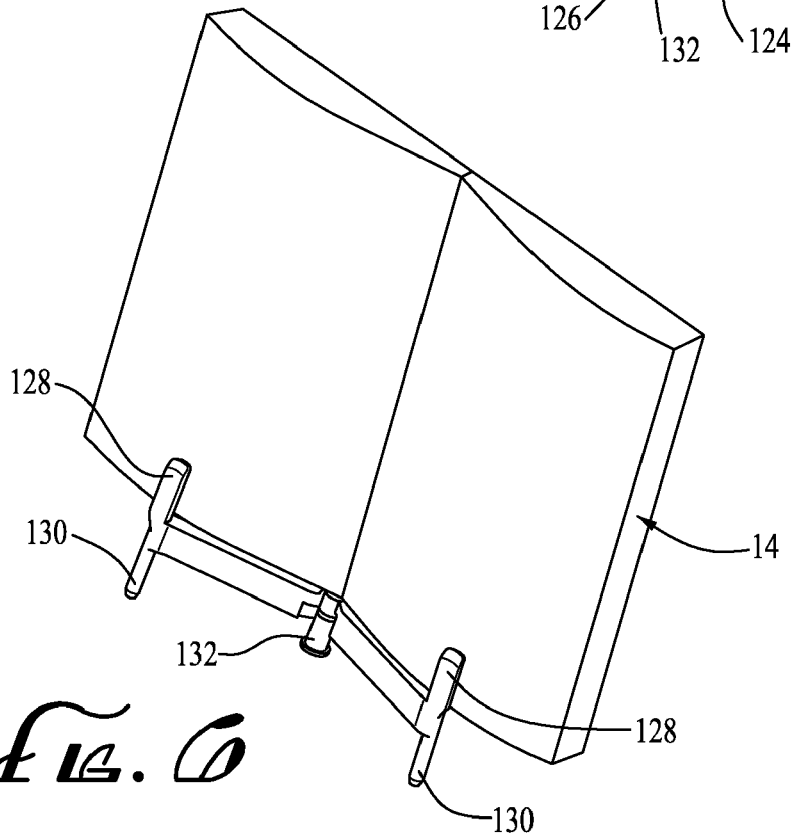
FIG. 6

PAGE TURNER WITH MOVING PAGE RETAINING ARMS AND METHOD OF OPERATION

FIELD OF THE INVENTION

The present invention relates to a compact, lightweight, and portable page turning device suitable for turning the bound pages of a book, magazine, or any bound printed matter in the forward or reverse directions.

BACKGROUND OF THE INVENTION

Reading books, magazines and printed materials is an essential part of our lives. Turning pages of a book or magazine can be cumbersome for avid readers and particularly difficult for disabled individuals. A page turner can serve as an assistive technology for people with disabilities and the elderly, who may have limited upper extremity function. A page turner can also furnish hands-free operation to musicians, and provide avid readers with convenient book holder and page turning features.

While there are many prior art automatic page turners, virtually none of them are successful working products. This is due to the fact that all of such prior art devices lack one or two of the three major functions of a successful page turner: engagement with the page, transport of the page, and restraining the book pages to lie flat. The prior art is replete with designs that are too bulky, noisy, or unreliable.

One example of the prior art is U.S. Pat. No. 7,238,872 B1 to Edwards et al., in which pages are loaded into the spaces between bars on a movable rack. One page is turned at a time by moving (translating) the rack across the book. As a bar makes its way from one side of the book to the other, the page alongside that bar is pushed across, thereby turning the page. The problem with this approach is that the bar must travel a relatively large distance from one side of the book to the other in order to turn a page. This forces the bars to be spaced farther apart for more reliable page turning operation. A bar may have to travel approximately one inch beyond the center (spine) of the book before a page is flipped across. For unidirectional operation, this distance corresponds to the spacing between the bars.

Bidirectional operation would be preferable. In that case, the bars must be situated symmetrically about the center of the book. Therefore, that one-inch movement corresponds to a travel distance of two inches for a bar (one inch to get to the center and one inch to move past the center). A book having pages that are 8.5" wide can only have four pages threaded between bars for reliable bidirectional page turning operation. Consequently, fewer bars can be packed together on the rack, limiting the number of pages that the rack can turn. In addition, the rack bars do nothing to secure the pages to lie flat while the book is opened.

What is needed is a page turner that is compact, silent, portable, reliable, and can be easily retrofitted to a wide range of bound printed matter, e.g., books and magazines.

SUMMARY OF THE INVENTION

The invention satisfies this need. The invention is a page turner apparatus comprising (a) a book holder assembly having a left side and a right side for retaining a book, magazine or other printed matter, such that the pages of the book, magazine or other printed matter can be alternatively disposed at a left side location proximate to the left side of the book holder assembly and/or at a right side location proximate to the right side of the book holder assembly; (b) at least one page turning assembly comprising a rotator portion and a page retention portion, the page retention portion having a pair of spaced apart page retaining arms defining a page retention gap therebetween, the at least one page turning assembly being laterally moveable to the left side of the book holder assembly and alternatively, to the right side of the book holder assembly, the page retaining arms being rotatable by the rotator about an axis of rotation such that the page retaining arms are rotated to the right of the axis of rotation when the at least one page turning assembly is moved to the right side of the book holder assembly and rotated to the left of the axis of rotation when the at least one page turner assembly is moved to the left side of the book holder assembly; and (c) driver means for laterally moving the at least one page turner assembly towards the right side of the book holder assembly and, alternatively, towards the left side of the book holder assembly and for driving the rotator to rotate the page retaining arms as the at least one page turning assembly is moved laterally back and forth between the left side of the book holder assembly and/or the right side of the book holder assembly.

DESCRIPTION OF THE DRAWINGS

These and other features, aspects and advantages of the present invention will become better understood with reference to the following description, appended claims and accompanying drawings where:

FIG. 4 is a side view of the page turner apparatus of FIG. 1;

FIG. 5 is a perspective view of a book holder assembly useable in the invention;

FIG. 6 is a perspective view of the book holder assembly of FIG. 5, shown with a mounted book;

DETAILED DESCRIPTION OF THE INVENTION

Figure 1:
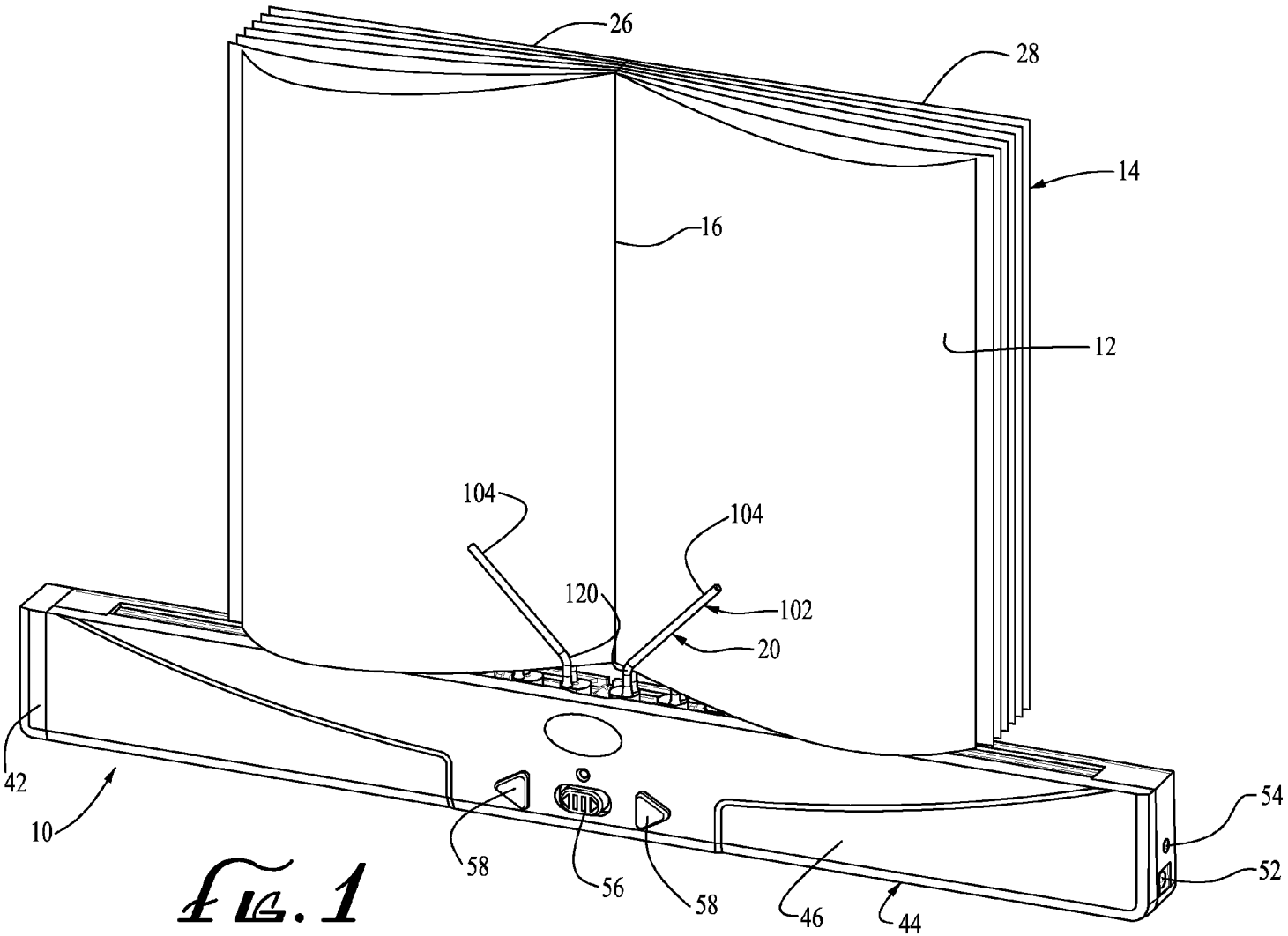
FIG. 1 is a perspective view of a page turner apparatus according to one embodiment of the present invention, shown with a mounted book.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a page turner apparatus 10 suitable for turning the pages 12 of a book, magazine or other printed material 14 having a plurality of pages 12 which can be turned from one side of a central axis 16 to the other. The page turner apparatus 10 of the invention comprises a book holder assembly 18 and at least one unique page turning assembly 20.

The book holder assembly 18 has a left side 22 and a right side 24 and is adapted for retaining a book, magazine or other printed material 14, such that the pages 12 of the book, magazine or other printed material 14 can be alternatively disposed at a left side location 26 proximate to the left side 22 of the book holder assembly 18 and/or at a right side location 28 proximate to the right side 24 of the book holder assembly 18.

The at least one page turning assembly 20 typically comprises a plurality of page turning assemblies, for instance 5-10 page turning assemblies. Each page turning assembly 20 comprises a rotator portion 30 and a page retention portion 32. The page retention portion 32 has a pair of spaced apart page retaining arms 34 defining a page retention gap 36 therebetween.

The at least one page turning assembly 20 is laterally movable to the left side 22 of the book holder assembly 18 and, alternatively, to the right side 24 of the book holder assembly 18.

The page retaining arms 34 are rotatable by the rotator portion 30 about an axis of rotation 38, such that the page retaining arms 34 are rotated to the right of the axis of rotation 38 when the at least one page turning assembly 20 is moved to the right side 24 of the book holder assembly 18 and are rotated to the left of the axis of rotation 38 when the at least one page turning assembly 20 is moved to the left side 22 of the book holder assembly 18.

In a typical embodiment, the page retaining arms 34 are rotatable through an angle of between about 120° and about 200°, most typically through an angle of about 180°.

The invention further comprises driver means 40 for laterally moving the at least one page turning assembly 20 towards the right side 24 of the book holder assembly 18 and, alternatively, towards the left side 22 of the book holder assembly 18, and for driving the rotator portion 30 to rotate the page retention portion 32 as the at least one page turning assembly 20 is moved laterally back and forth between the left side 22 of the book holder assembly 18 and the right side 24 of the book holder assembly 18. Typically, the driver means 40 comprises an electric motor assembly 42.

An example embodiment of the invention is illustrated in the drawings. Other embodiments of the invention will be readily appreciated by those of skill in the technology.

Referring to FIGS. 1, 2, 3, and 7, the page turner apparatus 10 can further comprise a casing 44 having a front cover 46 and a rear cover 48. The casing 44 provides structural support for the electric motor assembly 42, the book holder assembly 18, and the moving bracket assembly 50. In the embodiment illustrated in the drawings, an outlet 52 for AC power and a stereo plug outlet 54 for an auxiliary switch, such as a sip-and-puff or pushbutton switch, are located on the casing 44. The front cover 46 has an on-off button 56, and forward and reverse buttons 58 for initiating the forward and reverse movement of the pages 12. The rear cover 48 has two slots 60 which facilitate the attachment of the book holder assembly 18 to the casing 44. In addition, the rear cover 48 has a battery housing 62.

Figure 9:
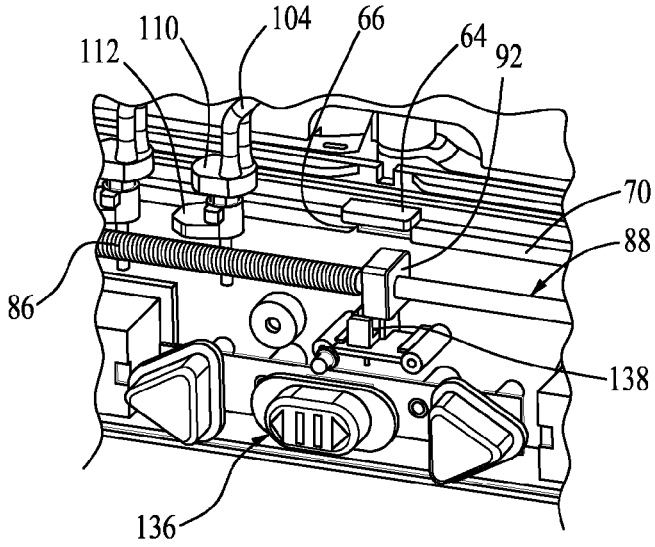
FIG. 9 is a detailed view of a cam assembly useable in the invention.
Figure 11:
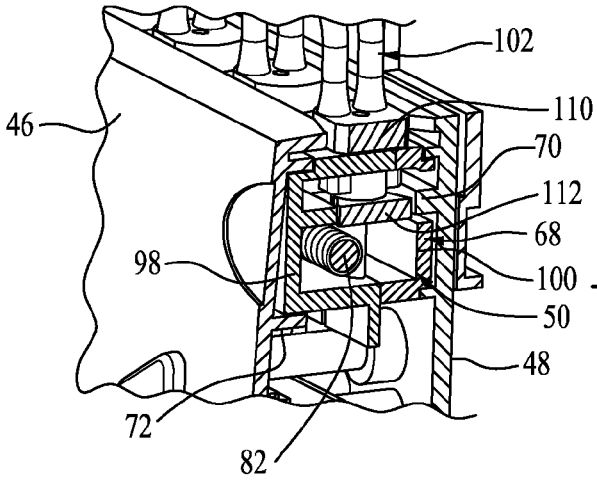
FIG. 11 is a perspective cross-sectional detail view of a bracket assembly useable in the invention.

As shown in FIGS. 9 and 11, the interior surface of the rear cover 48 has a protrusion 64 and a cavity 66 which are instrumental in turning the at least one page turning assembly 20. In addition, the interior surface of the rear cover 48 has a horizontal guide rail 70 which provides a supporting surface for the at least one page turning assembly 20 and for the moving bracket assembly 50.

Figure 7:
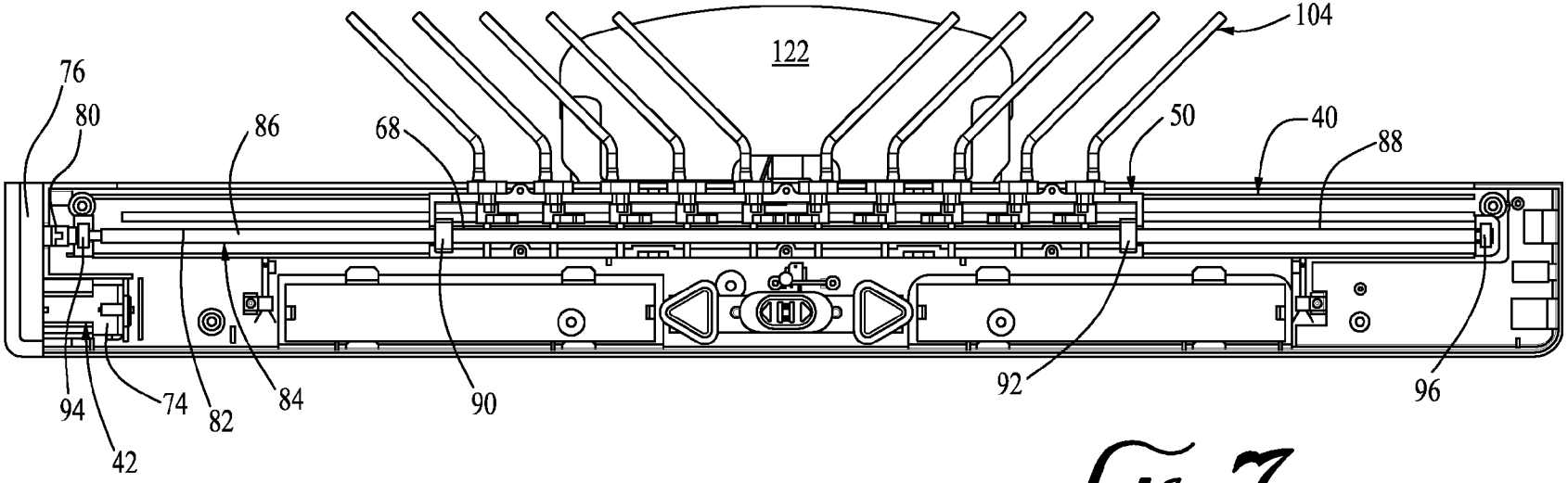
FIG. 7 is a front view of the page turner apparatus of FIG. 1 with the front cover removed.
Figure 8:
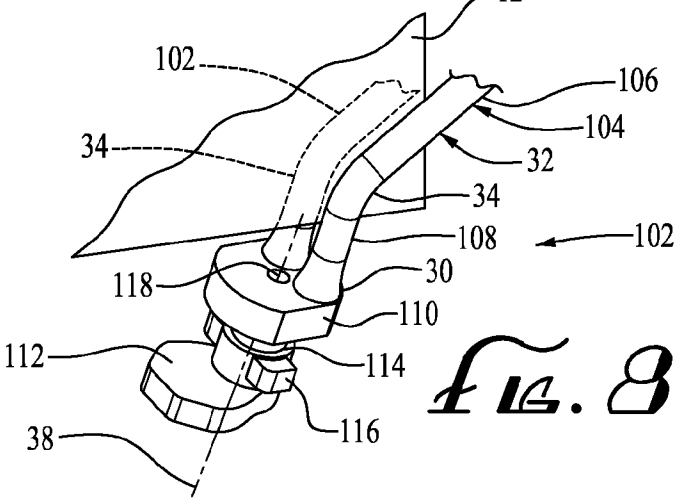
FIG. 8 is a perspective view of a forked-arm assembly useable in the invention, shown with an inserted page.

Referring to FIG. 7, the electric motor assembly 42 has a reversible electric motor 74, and a gear reduction train 76. The output shaft of the electric motor 74 is coaxially connected with the gear reduction train 76, which is comprised of a series of shafts and engaging helical gears and pinions. The gear reduction train 76 significantly reduces the RPM of the motor output. The gear reduction train 76 has an output shaft 80 which is coaxially and rigidly connected to a lead screw 82.

The motor assembly can be energized utilizing the forward and reverse buttons 58 located on the front cover 46 of the casing 44, or, optionally, through a pedal, a breath-controlled switch, a chin switch, or a voice activation device.

Referring to FIGS. 7 and 9, a lead screw assembly 84 is shown comprising the lead screw 82 with a threaded portion 86 and a non-threaded shaft portion 88. The threads of the threaded portion 86 are engaged with a first screw nut 90, while the shaft portion 88 is slideably engaged with a second nut 92. The threaded portion 86 is supported by a lead screw bearing 94 that is located on the casing 44. The distal end of the shaft portion is supported by a shaft bearing 96 also located on the casing 44.

As best seen in FIGS. 7 and 11, in the embodiment illustrated in the drawings, the driver means 40 further comprises the moving bracket assembly 50 having a moving bracket 68 with a front cover 98 and a rear cover 100. The left and right sides of these covers 46 and 48 are rigidly connected to the first screw nut 90 and to the second nut 92 of the lead screw assembly 84. The movement of the moving bracket assembly 50 is also restrained by a horizontal guide 72 located on the interior surface of the front cover 46 of the casing 44 and by the guide rail 70 located on the interior surface of the rear cover 48 of the casing 44. When the motor 74 is energized, the output shaft 80 of the gear reduction train 76 turns the lead screw 82. The first screw nut 90, which is affixed to the moving bracket 68, causes the moving bracket 68 to slide to the left or right as the lead screw 82 turns.

As noted above, the at least one page turning assembly 20 is typically provided by a plurality of page turning assemblies 20. Each page turning assembly 20 can be constructed in a wide variety of shapes and configurations. The drawings illustrate a plurality of particularly effective page turning assemblies 20, each configured as a forked-arm assembly 102. Each forked-arm assembly 102 is comprised of a forked-arm 104. Each forked-arm 104 comprises a pair of spaced apart tines 106 which provide the pair of spaced apart page retaining arms 34. The pair of tines 106 are both connected to a forked-arm shaft 108 which acts as the rotator portion 30.

Each forked-arm assembly 102 is rigidly connected to a base 110. The base 110 is in turn rigidly connected to a turning cam 112 by a vertical base section 114. The base 110 is also restrained by the horizontal guides 70 and 72 on the interior surfaces of the casing 44. Between the base 110 and the turning cam 112, along the surface of the vertical base section 114, two protrusions 116 extend outwardly in a diagonal orientation. The base 110 defines an axial cylindrical bore 118 which runs vertically through the center of the base 110. Each forked-arm shaft 108 is coaxially disposed in the cylindrical bore 118 allowing each forked-arm assembly 102 to rotate about the axis of rotation 38.

Each tine 106 on each forked-arm 104 has a bend 120. In a typical embodiment, the bend 120 is such that the distal end of each tine 106 is disposed at an angle α between about 20° and about 70° with respect to the axis of rotation 38.

The page retention gap 36, in which a page 12 of a book 14 can be inserted, is formed by the space between the two tines 106 of each forked-arm 104. When the bracket assembly 50 moves, each forked-arm 104 slides across the page 12 of the book 14 (or other printed matter) which has been inserted in its page retention gap 36. Once a forked-arm 104 passes across the central axis 16 of the book 14, i.e., at the spine, the forked-arm 104 rotates. A page 12 is turned through the translational and rotational motion of this forked-arm 104, coupled with the effect of the bend 120 in the tines 106 that spreads this force across a wide area of the turning page 12.

As can be seen in the drawings, in the illustrated embodiment, ten forked-arms 104 are used to turn ten sheets (twenty pages; two pages 12 per sheet).

As illustrated in FIGS. 4, 5 and 6, the book holder assembly 18 in the embodiment illustrated in the drawings further comprises a supporting plate 122, a pair of pivoting arms 124, and a torsional spring 126. The distal end of each pivoting arm has a page restraint 128 and a peg 130 that can slide into a slot in the rear cover 48 to attach the book holder assembly 18 to the casing 44 of the page turner. The slots 60 are preferably configured with excess width to accommodate books of different sizes.

The proximal ends of the pivoting arms 124 are pivotally connected at the middle section of a supporting plate 122 in the book holder assembly 18 by a hinge 132, comprising a pin and the torsional spring 126. The torsional spring 126 is coaxially located on the hinge 132 and applies a bias torque on the pivoting arms 124. This permits the pivoting arms 124 to apply a compressive force on book pages 12 that are clamped between the page restraints 128 and the supporting plate 122. This serves to hold the book pages 12 wide open, even for new books 14 with tight spines that are not conditioned to stay open freely.

Figure 2:
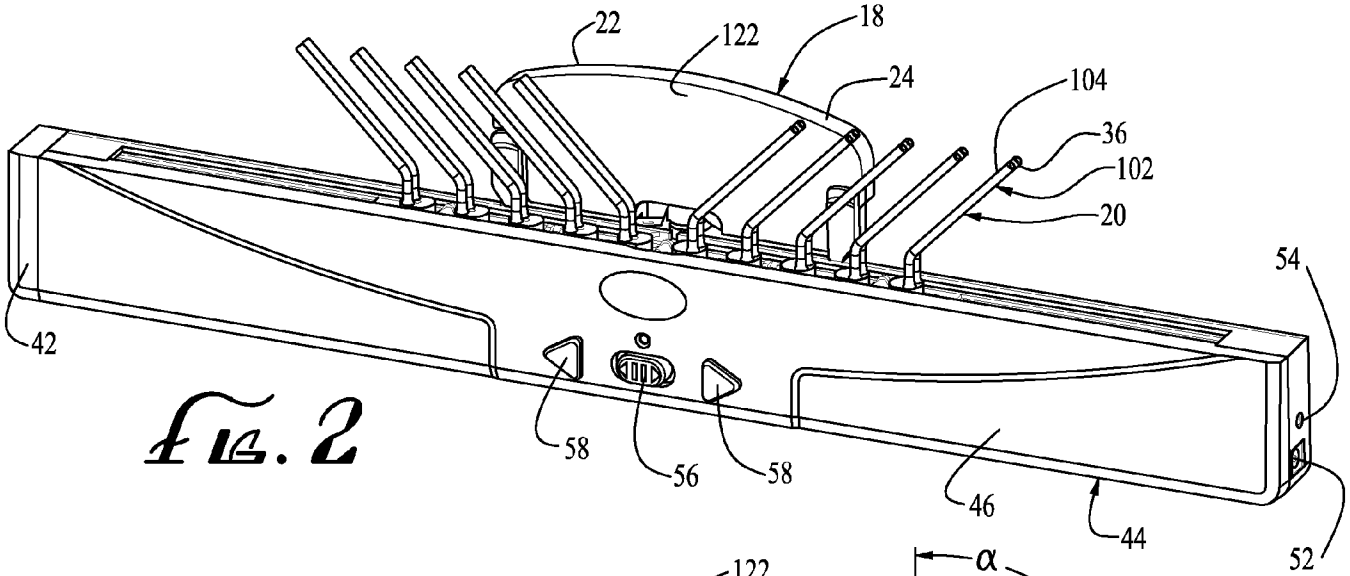
FIG. 2 is a second perspective view of the page turner apparatus of FIG. 1, shown without a mounted book.
Figure 3:
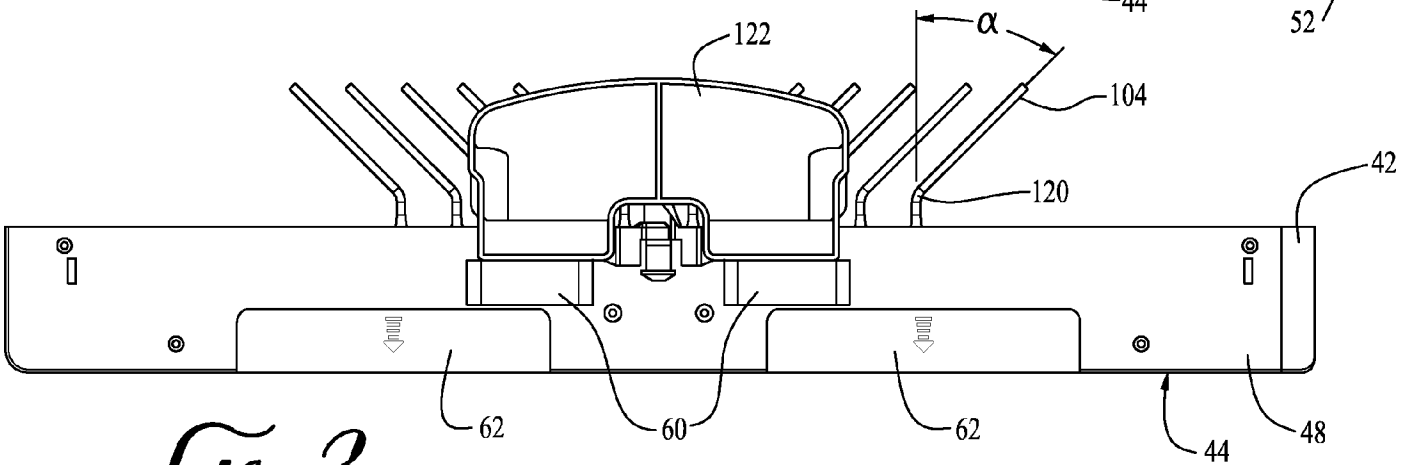
FIG. 3 is a rear view of the page turner apparatus of FIG. 1.

Referring to FIGS. 1, 2 and 9, a control system assembly 136 is provided in the embodiment illustrated in the drawings. The control system assembly 136 consists of the on-off button 56, the forward and reverse buttons 58, an integrated circuit, (not shown), and an electric eye sensor 138. The control system assembly 136 is configured such that, when the moving bracket 68 slides to the left or right, and the forked-arm assemblies 102 move accordingly, as a forked-arm shaft 108 crosses over a beam of light emitted by the sensor 138, the electric motor 74 is caused to stop. The stereo plug outlet 54 can be used to attach auxiliary activation devices, such as sip-and-puff and pushbutton switches.

The page turner apparatus 10 may be used in a variety of orientations with different mounting options. The page turner apparatus 10 may be placed on a table, a ledge of a music stand, or a standard book stand. In the conventional approach, as shown in FIG. 1, the pegs 130 of the book holder assembly 18 are inserted into the slots 60, with the book holder assembly 18 clamped to the bottom edge of the book 14. The book 14 then rests flat on the supporting plate 122. The page turner apparatus 10 may also be turned upside down and attached along the top edge of a book 14. This is particularly useful for heavy music books 14 since such books 14 are more cumbersome to pick up in order to clip the book holder assembly along the bottom edge of the book 14.

Once the page turner apparatus 10 is conveniently placed on a table, music stand or ledge, the page turner apparatus is powered by plugging a conventional power cord to the AC outlet 52 or, in a portable cordless version of the apparatus, by using a plurality of small conventional dry-cell batteries that are located in the battery housing 62. The on/off button 56 conveniently located on the front cover 46 can be activated to energize the page turner apparatus 10. The control system assembly 136 then initiates the movement of the set of forked-arms 104.

Instead of using the on/off button 56 and the forward and reverse buttons 58, alternate triggers may by used to energize the electric motor 74. Alternate triggers include, but are not limited to, pedals, breath-controlled switches, chin switches, voice activation devices, and computerized timers.

Figure 15:
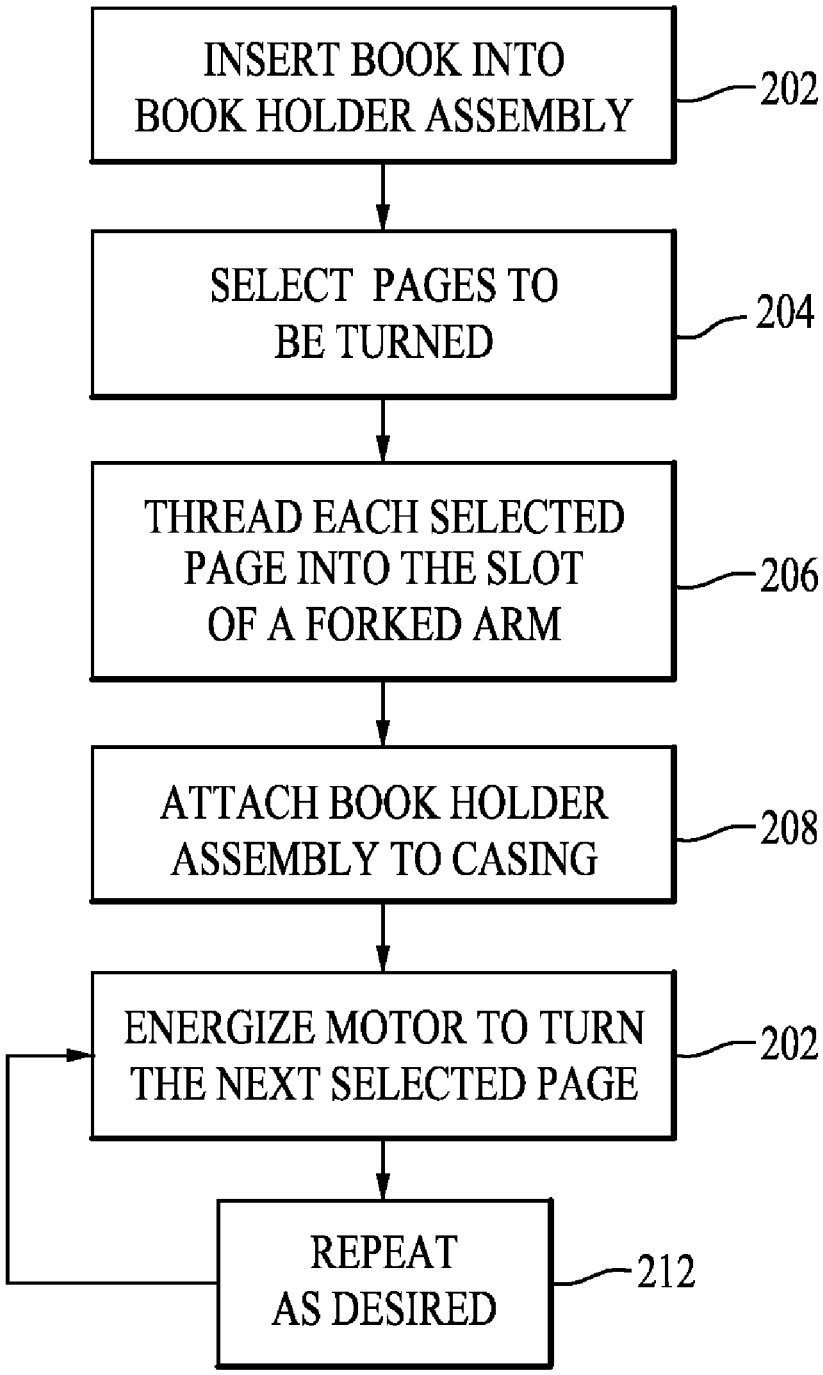
FIG. 15 is a logic diagram illustrating operation of one embodiment of the invention.

As shown in FIG. 15, one method of operating the page turner assembly 10 of the embodiment illustrated in the drawings comprises the following steps. First, in step 202, a book (or other printed material) 14 is inserted into the book holder assembly 18 by using two fingers to separate the two page restraints 128 from the supporting plate 122, leaving space to insert the book 14. By releasing the pivoting arms 124, the page restraints 128 at the distal ends of the pivoting arms 124 apply a compressive force on the book pages 12 through the torsional spring 126. This process secures the book 14 between the page restraints 128 and the supporting plate 122.

Next, in step 204, the user separates a selected batch of pages 12 from the remaining non-selected pages 12. The selected pages 12 are those which the user desires to be turned. The selected pages 12 are removed from under the page restraints 128 so that they may be engaged with the forked-arms 104. In step 206, successive selected pages 12 are each threaded into a page retention gap 36 of a forked-arm 104, one at a time. In step 208, the book 14 and the casing 44 are attached together by placing the pegs 130 of the book holder assembly 18 into the slots 60 at the rear cover 48 of the casing 44.

Figure 10:
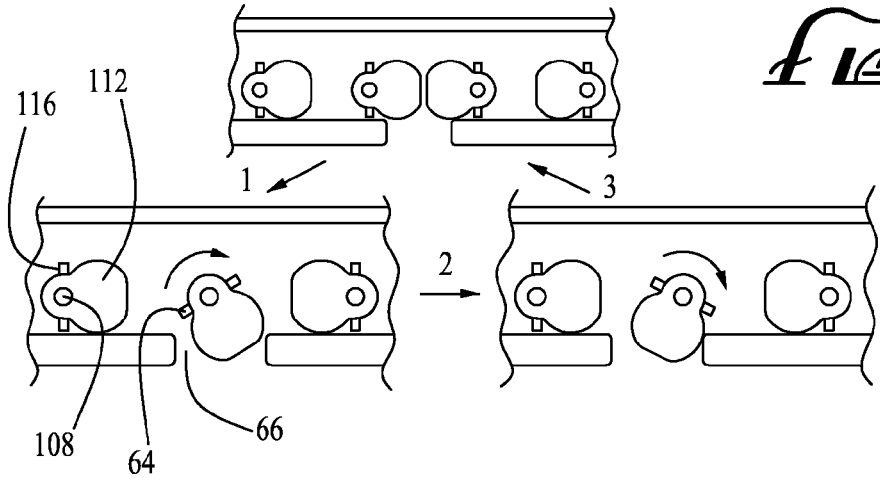
FIG. 10 diagrammatically depicts the rotation sequence of a turning cam useable in the invention.

Next, in step 210, the user energizes the electric motor 74 by manually pressing the forward/reverse buttons 58, or by other means as explained above, thereby causing the output shaft 80 of the electric motor assembly 42 to turn the lead screw 82. Since the first screw nut 90 is engaged with the lead screw 82 where its rotation is restrained by the casing 44, the first screw nut 90 moves along the longitudinal axis of the lead screw 82. The moving bracket assembly 50 that is rigidly connected to the first screw nut 90 then slides along the guide rails 70 and 72 of the casing 44. Then, as shown in FIGS. 9 and 10, as the shaft bearing 96 moves, the protrusion 116 on the vertical base section 114 comes in contact with the protrusion 64 on the interior surface of the casing 44. This causes the forked-arm 104 to rotate 90 degrees about the axis of rotation 38. At the same time, the turning cam 112 rotates and enters into the cavity 66 on the rear surface of the casing 44. Then, the side surface of the turning cam 112 comes in contact with the boundary of the cavity 66, and since the bracket assembly 50 is still moving, the turning cam 112 forces the forked-arm 104 to further rotate another 90 degrees. This completes the 180-degree rotation of the forked-arm 104 that turns the page 12.

Once the rotation of the forked-arm 104 is completed, the forked-arm shaft 108 passes across over the electric eye sensor 138 which stops the electric motor 74. To turn more pages 12 the above-mentioned operation is repeated (Step 212).

Figure 12:
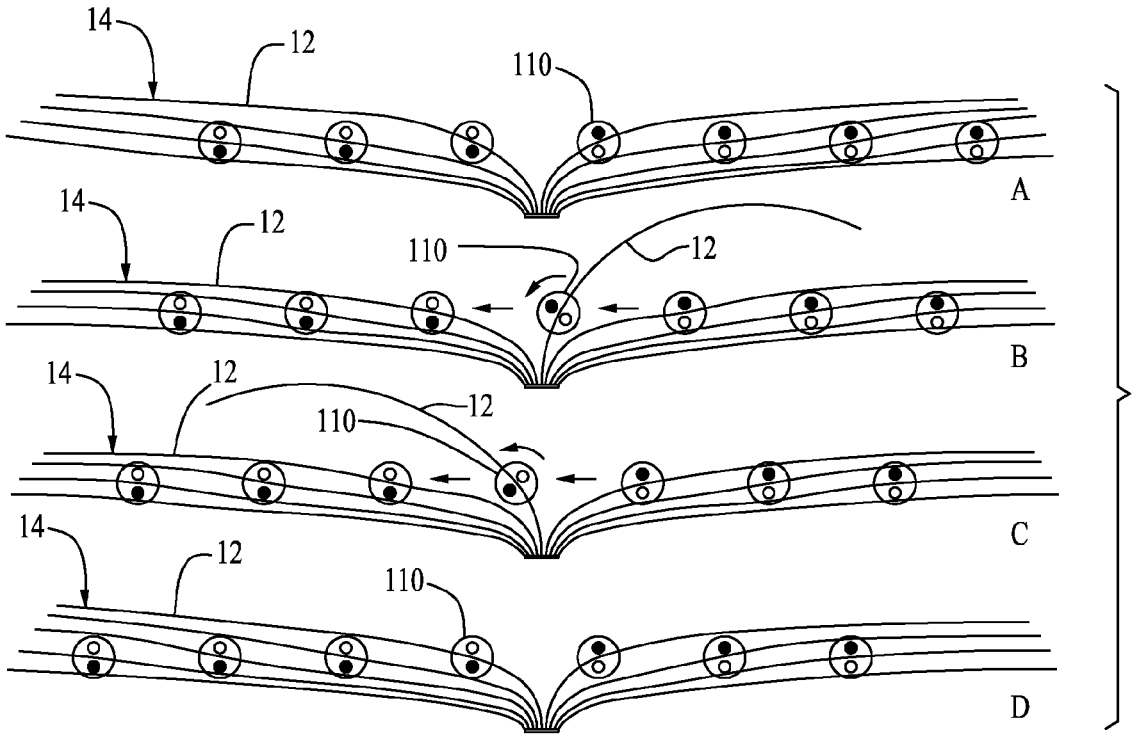
FIG. 12 is schematic view illustrating the movement of the forked-arms of FIG. 8 as they turn a page of a book.
Figure 13:
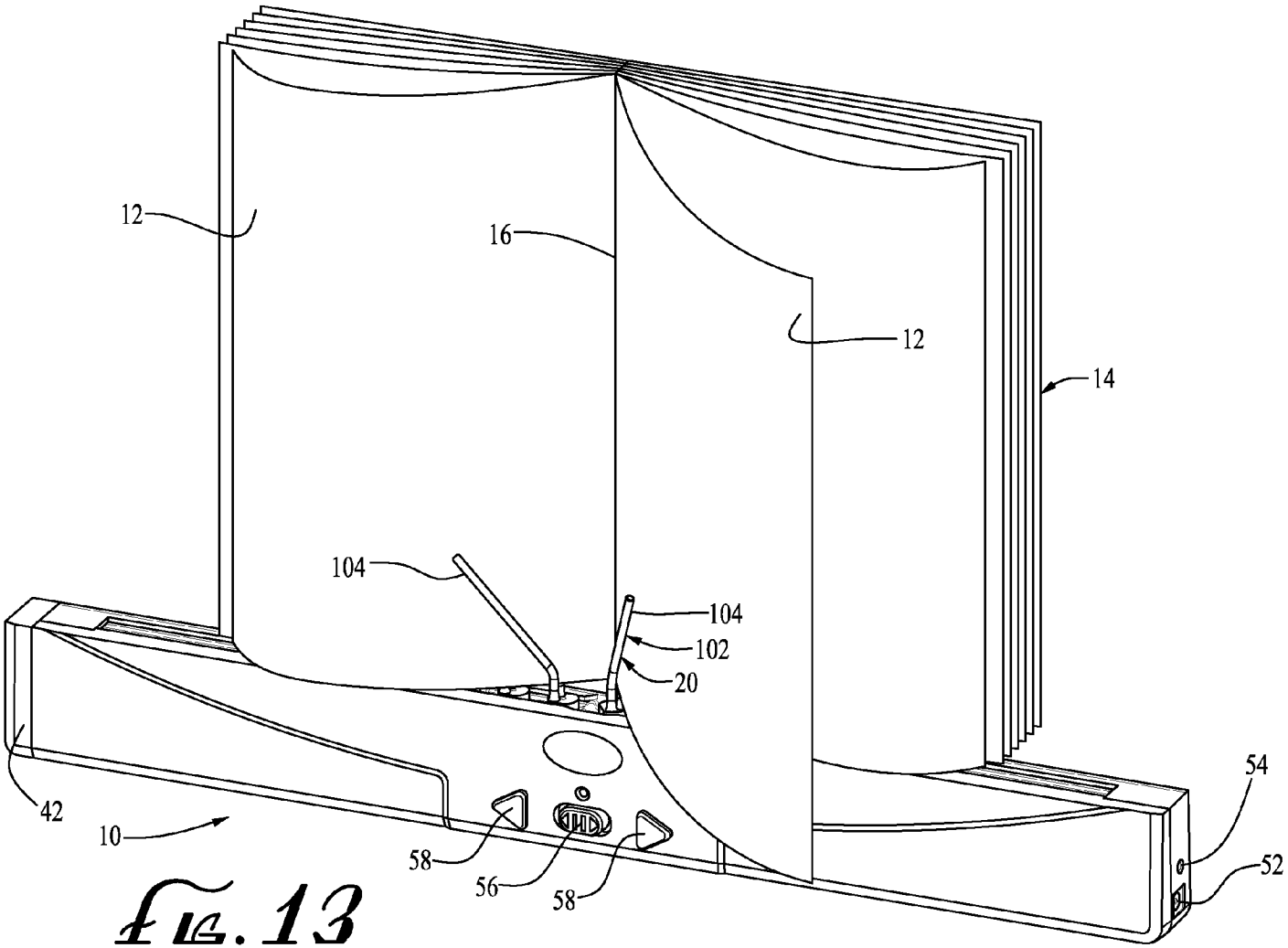
FIG. 13 is a first perspective view of the movement of forked-arms as they turn a page of a book.
Figure 14:
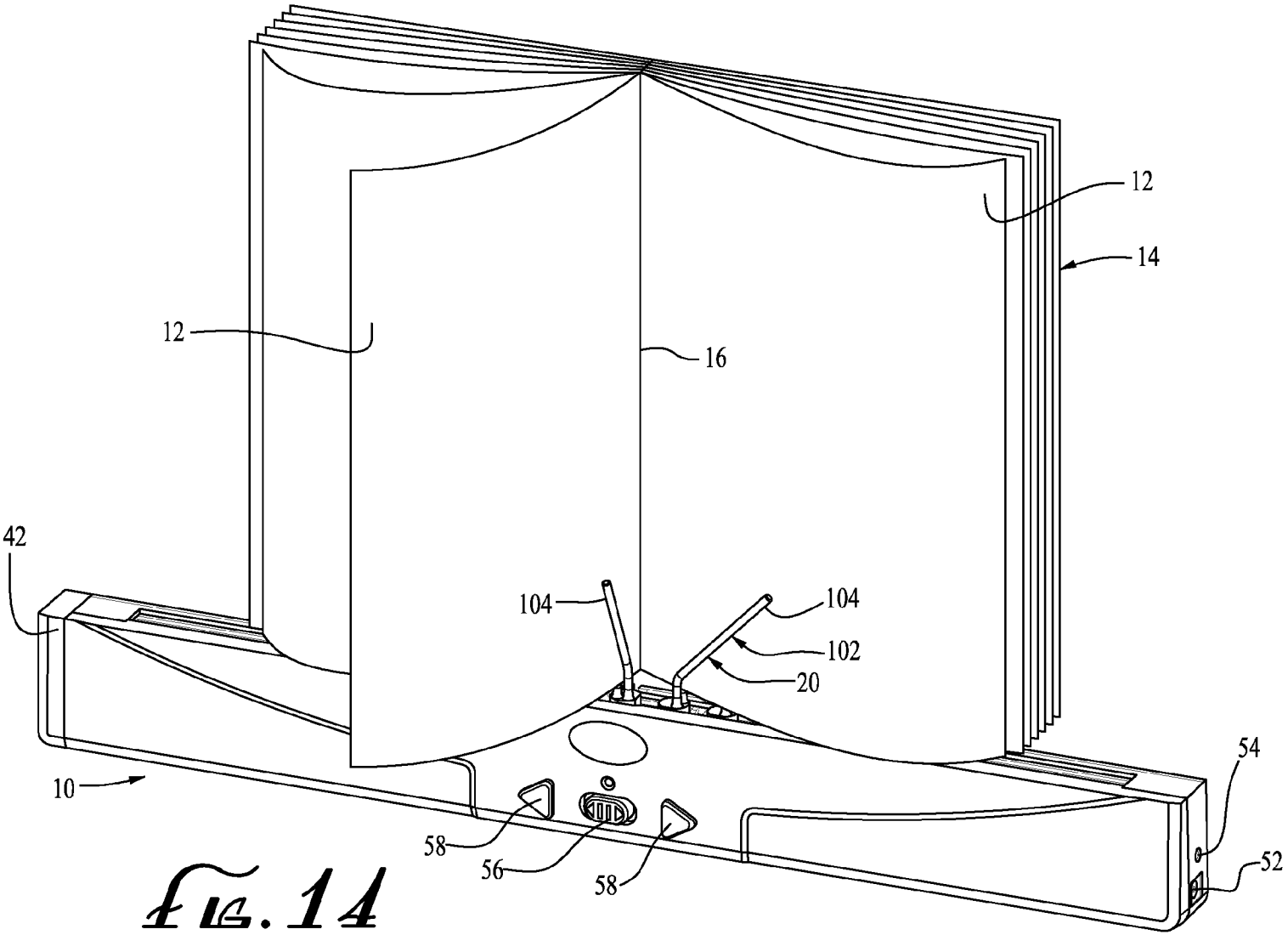
FIG. 14 is a second perspective view of the movement of the forked-arms as they turn a page of a book illustrated in FIG. 13.

The sequence of the rotation and translation of the shaft bearing 96 is illustrated schematically in FIG. 10. In addition, FIGS. 12, 13, and 14 illustrate the engagement of the forked-arms 104 with pages 12 of a book and how a page 12 is turned through the translation and rotation of a forked-arm 104.

The invention addresses the need to securely restrain the book pages 12 to stay open. This is a problem that is virtually ignored in the prior art. Books 14 are tightly clamped to the book holder assembly 18 and the holder assembly 18 is installed into the two rear slots 60 of the casing 44. Since most of the book 14 remains clamped to the book holder assembly 18, only a few selected pages 12 that are to be threaded in the slots 60 are free to turn. To address the problem of pages 12 drifting inconveniently away from the book 14, the rack bars of the prior art are replaced with forked-arms 104. This traps each page 12 so that the pages 12 are not free to drift.

The forked-arms 104 do not simply move (translate) along the pages 12 to achieve the page turning action. Instead, a rotational component is provided to the motion for each forked-arm 104 that crosses the central axis 16 of the book 14. This more effectively swings the page 12 across the book 14 and allows the forked-arms 104 to be more tightly packed together, thereby increasing the number of pages 12 that the plurality of forked-arms 104 can turn. It is this translation-rotation motion of the forked-arms 104 that effectively turns pages 12 with smaller movement of the plurality of forked-arms 104. The plurality of forked-arms 104 rigidly constrain the loose pages 12 to lie flat.

Unlike devices of the prior art, the page turner apparatus 10 of the invention guarantees 100% accuracy in turning one page 12 at a time. Also, unlike in page turning devices of the prior art, the forked-arms 104 undergo rotation about their own axes in addition to translational movement. The forked-arms 104 are bent with a particular curvature to create a spatial (out-of-plane of the book 14) rotation of the book pages 12. This mimics and follows the trajectory of human fingers during turning a page 12. The prior art used only straight arms which can cause page jams.

The versatility of the page turner apparatus allows it to be attached to the top of a book 14 and operated upside down to facilitate turning the pages 12. The benefit of this approach is that the heavy book 14 does not have to be lifted before attaching the page restraints 128 and page turner assemblies 20 to the book 14.

Having thus described the invention, it should be apparent that numerous structural modifications and adaptations may be resorted to without departing from the scope and fair meaning of the invention as set forth hereinabove and as described hereinbelow by the claims.

What is claimed is:

1. A page turner apparatus suitable for turning the pages of a book, magazine, or other printed matter having a plurality of pages which can be turned from one side of a central axis to the other, the apparatus comprising:

(a) a book holder assembly having a left side and a right side for retaining a book, magazine or other printed matter, such that the pages of the book, magazine or other printed matter can be alternatively disposed at a left side location proximate to the left side of the book holder assembly and/or at a right side location proximate to the right side of the book holder assembly;

(b) at least one page turning assembly comprising a rotator portion and a page retention portion, the page retention portion having a pair of spaced apart page retaining arms defining a page retention gap therebetween, the at least one page turning assembly being laterally moveable to the left side of the book holder assembly and alternatively, to the right side of the book holder assembly, the page retaining arms being rotatable by the rotator about an axis of rotation such that the page retaining arms are rotated to the right of the axis of rotation when the at least one page turning assembly is moved to the right side of the book holder assembly and rotated to the left of the axis of rotation when the at least one page turner assembly is moved to the left side of the book holder assembly; and (c) driver means for laterally moving the at least one page turner assembly towards the right side of the book holder assembly and, alternatively, towards the left side of the book holder assembly and for driving the rotator to rotate the page retaining arms as the at least one page turning assembly is moved laterally back and forth between the left side of the book holder assembly and/or the right side of the book holder assembly.

2. The page turner apparatus of claim 1 wherein the driver means comprises an electric motor, a gear reduction train and a lead screw.

3. The page turner apparatus of claim 2 wherein the driver means further comprises a moving bracket assembly coupled to the lead screw, such that the rotation of the lead screw in a first direction causes the moving bracket to move to the left, and such that the movement of the lead screw in the opposite direction causes the moving bracket assembly to move to the right.

4. The page turner assembly of claim 1 wherein the at least one page turning assembly comprises a plurality of forked-arm assemblies, each forked-arm assembly comprising a forked-arm, each forked-arm comprising a pair of spaced apart tines coupled to a forked-arm shaft, each forked-arm shaft being rotatable about an axis of rotation.

5. The page turner assembly of claim 4 wherein each tine is disposed at an angle between about 20° and about 70° with respect to the axis of rotation.

6. The page turner assembly of claim 1 wherein the book holder assembly further comprises a supporting plate, a pair of pivoting arms, and a torsional spring, and wherein the distal end of each pivoting arm has a page restraint.

7. The page turner assembly of claim 4 further comprising a casing having a plurality of guide rails, a casing protrusion and a cavity which cooperate to guide the moving bracket assembly and rotate each forked-arm assembly.

8. The page turner assembly of claim 7 wherein each forked-arm assembly is rigidly connected to a base, each base being rigidly connected to a turning cam via a vertical base section, and each vertical base section comprising two protrusions extending outwardly in a diagonal orientation.

9. The page turner assembly of claim 1 wherein each page retaining arm is rotatable through an angle of between about 120° and about 200°.

10. A page turner apparatus suitable for turning the pages of a book, magazine, or other printed matter having a plurality of pages which can be turned from one side of a central axis to the other, the apparatus comprising:

(a) a book holder assembly having a left side and a right side for retaining a book, magazine or other printed matter, such that the pages of the book, magazine or other printed matter can be alternatively disposed at a left side location proximate to the left side of the book holder assembly and/or at a right side location proximate to the right side of the book holder assembly;

(b) a plurality of page turning assemblies, each page turning assembly comprising a rotator portion and a page retention portion, the page retention portion having a pair of spaced apart page retaining arms defining a page retention gap therebetween, each one page turning assembly being laterally moveable to the left side of the book holder assembly and alternatively, to the right side of the book holder assembly, the page retaining arms being rotatable by the rotator about an axis of rotation such that the page retaining arms are rotated to the right of the axis of rotation when its page turning assembly is moved to the right side of the book holder assembly and rotated to the left of the axis of rotation when its page turner assembly is moved to the left side of the book holder assembly; and (c) driver means for laterally moving each page turner assembly towards the right side of the book holder assembly and, alternatively, towards the left side of the book holder assembly and for driving the rotator to rotate the page retaining arms as its page turning assembly is moved laterally back and forth between the left side of the book holder assembly and/or the right side of the book holder assembly;

wherein the driver means comprises an electric motor, a gear reduction train and a lead screw;

wherein the driver means further comprises a moving bracket assembly coupled to the lead screw, such that the rotation of the lead screw in a first direction causes the moving bracket to move to the left, and such that the movement of the lead screw in the opposite direction causes the moving bracket assembly to move to the right; and wherein the book holder assembly further comprises a supporting plate, a pair of pivoting arms, and a torsional spring, and wherein the distal end of each pivoting arm has a page restraint.

11. The page turner assembly of claim 10 wherein the at least one page turning assembly comprises a plurality of forked-arm assemblies, each forked-arm assembly comprising a forked-arm, each forked-arm comprising a pair of spaced apart tines coupled to a forked-arm shaft, each forked-arm shaft being rotatable about an axis of rotation.

12. The page turner assembly of claim 11 wherein each tine is disposed at an angle between about 20° and about 70° with respect to the axis of rotation.

13. The page turner assembly of claim 11 further comprising a casing having a plurality of guide rails, a casing protrusion and a cavity which cooperate to guide the moving bracket assembly and rotate each forked-arm assembly.

14. The page turner assembly of claim 11 wherein each forked-arm assembly is rigidly connected to a base, each base being rigidly connected to a turning cam via a vertical base section, and each vertical base section comprising two protrusions extending outwardly in a diagonal orientation.

15. A method for turning the pages of a book, magazine or other printed matter having a front cover, a rear cover and a plurality of pages which can be turned from one side of a central axis to the other, the method comprising the steps of:

(a) providing the page turner assembly of claim 6 having a plurality of page retaining arms;

(b) opening the book, magazine or other printed matter and placing it on the support plate with its front cover and the left side of the book holder assembly and with its rear cover on the right side of the book holder assembly;

(c) defining the pages of the book, magazine or other printed matter as being either selected pages or non-selected pages, and restraining the front cover, the rear cover and the non-selected pages against the support plate with the page restraints;

(d) placing each of the selected pages into a page retention gap of a page retaining arm; and (e) using the driver means to cause a page retaining arm to move from one side of the book holder assembly to the other side and to rotate a page retaining arm as it is moved laterally between one side of the book holder assembly and/or the other side of the book holder assembly.

* * * * *